United States Patent [19]

Fuller et al.

[11] Patent Number: 4,630,012

[45] Date of Patent: Dec. 16, 1986

[54] RING SHAPED DIELECTRIC RESONATOR WITH ADJUSTABLE TUNING SCREW EXTENDING UPWARDLY INTO RING OPENING

[75] Inventors: Ronald D. Fuller; Benny W. Lowe, both of Mesa, Ariz.

[73] Assignee: Motorola, Inc., Schaumburg, Ill.

[21] Appl. No.: 565,943

[22] Filed: Dec. 27, 1983

[51] Int. Cl.[4] ..... H01P 7/10

[52] U.S. Cl. ..... 333/235; 333/219

[58] Field of Search ..... 333/219, 222, 223, 226, 333/227, 231, 332, 235, 202, 206, 207, 208, 209; 331/96; 334/41, 68

[56] References Cited

U.S. PATENT DOCUMENTS

| | | | |
|---|---|---|---|
| 4,028,652 | 6/1977 | Wakino et al. | 333/235 X |
| 4,385,279 | 5/1983 | Meador | 333/235 |

FOREIGN PATENT DOCUMENTS

| | | | |
|---|---|---|---|
| 2529141 | 1/1977 | Fed. Rep. of Germany | 333/231 |
| 0039042 | 4/1978 | Japan | 333/235 |
| 0154960 | 12/1979 | Japan | 333/202 |
| 0074217 | 6/1980 | Japan | 333/234 |
| 0085101 | 6/1980 | Japan | 333/202 |
| 0141803 | 11/1980 | Japan | 333/219 |
| 0062405 | 3/1981 | Japan | 331/96 |
| 0150203 | 9/1982 | Japan | 333/219 |
| 0036002 | 3/1983 | Japan | 333/202 |

*Primary Examiner*—Eugene R. LaRoche
*Assistant Examiner*—Benny T. Lee
*Attorney, Agent, or Firm*—Eugene A. Parsons

[57] ABSTRACT

A ring shaped dielectric resonator tuned by inserting a bolt from below the resonator into an opening of the resonator. The bolt causes the dielectric constant of the opening to change. The change in the dielectric constant changes the electric field which in turn changes the magnetic field of the resonator.

1 Claim, 3 Drawing Figures

— PRIOR ART —

RING SHAPED DIELECTRIC RESONATOR WITH ADJUSTABLE TUNING SCREW EXTENDING UPWARDLY INTO RING OPENING

BACKGROUND OF THE INVENTION

1. Field of the Invention

This invention relates, in general, to dielectric resonators and more particularly to ring shaped dielectric resonators.

2. Description of Background Art

A typical ring shaped dielectric resonator is tuned by a tuning screw, made of either a metal or dielectric material, from above the dielectric resonator. As the tuning screw is adjusted, the distance between the tuning screw's end and the dielectric resonator varies affecting the electric field of the resonator, which in turn affects the magnetic field of the resonator.

As a signal is processed through the dielectric resonator, four first order modes ($TE_{01\delta}$, $TM_{01\delta}$, $HE_{11\delta}$, $EH_{11\delta}$) are created. Mode $TE_{01\delta}$ is considered the fundamental mode and the remaining modes are considered the spurious responses (or spurs), or spurious responses such as $TM_{01\delta}$ and $HE_{11\delta}$, are created. As the resonator is tuned, the spurious responses move toward the fundamental response, causing distortion of the fundamental response.

In addition, for a ring shaped dielectric resonator to be effective, a very high accuracy, or a very tight tolerance in dimension, is required in the design of the dielectric resonator. This low tolerance is difficult to achieve with present manufacturing capabilities.

Further, in the past resonators have used a large tuning screw to tune the dielectric resonator. These large tuners cause problems when the resonators are required to be close together. Physically it is difficult to access the tuner since the heads of the screws are so close together. In addition, when the resonators are placed close together, tuning one resonator often has a tuning effect on adjacent resonators.

SUMMARY OF THE INVENTION

Accordingly, it is an object of the present invention to provide an apparatus and method for tuning a ring shaped dielectric resonator that will increase the tuning bandwidth without having spurious responses interfere with the fundamental response.

Another object of the present invention is to provide ring shaped dielectric resonators which require less dimensional tolerances so as to be practical and economical to produce.

Still another object of the present invention is to provide ring shaped dielectric resonators that may be placed in close proximity to one another and be easily adjusted.

Yet another object of the present invention is to provide ring shaped dielectric resonators that may be placed in close proximity to one another and tuned without effecting adjacent resonators.

Yet another object of the present invention is to provide an improved tuning apparatus and method for tuning a dielectric resonator, without loss in the quality, or Q, factor.

The above and other objects and advantages of the present invention are provided by a method and apparatus for tuning a ring shaped dielectric resonator from below, through a pedestal. This is accomplished by perturbing the electric field of the fundamental mode of the ring shaped dielectric resonator. The electric field of the fundamental mode is strongest at the resonator's center and is perturbed through insertion of a tuning screw, of either dielectric or metallic material, through the pedestal of the resonator into the hole of the dielectric. This tuning method has minimal effect on the $TM_{01\delta}$, $HE_{11\delta}$ and the $EH_{11\delta}$ modes which are the next higher order modes.

DRAWINGS

DETAILED DESCRIPTION

Figure 1:
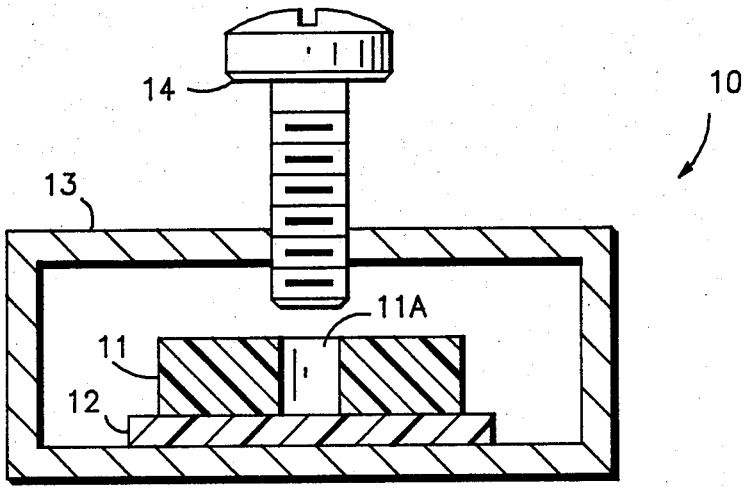
FIG. 1 is a cross sectional diagram of a prior art ring shaped dielectric resonator.

A prior art ring shaped dielectric resonator, generally designated 10, is illustrated in FIG. 1. The standard resonator consists of a ring shaped dielectric 11, having an opening 11A, mounted on a pedestal 12. Pedestal 12 is a nonconducting dielectric and is mounted to a ground plane 13 which encloses resonator 11. Threadedly engaged in ground plane 13 above dielectric 11 is a tuning screw 14 which is composed of either a dielectric or metallic substance, depending on the type of tuning required. In resonator 10 it is required that dielectric 11 be ground to a tolerance of ±0.5% of its desired dimension to satisfactorily accomplish the tuning desired. Present manufacturing capabilities make this level of tolerance difficult to achieve. Even when the required tolerances are met the aspect ratio (diameter to thickness of the dielectric resonator) must be chosen to place the spurious responses outside of the operating frequency band, as practical design work has shown, this can be accomplished only if the filter requires little or no tuning. (Ren, "Mode Suppressor for Dielectric Resonator Filters," 1982 IEEE MTT-S Digest, 389-390.) Further, resonator 10 has a tuning range of less than 0.1% of the resonator's untuned frequency. This means that as the tuned frequency of resonator 10 increases, or decreases by 0.1% of the untuned frequency, a spurious response will interfere with the fundamental response causing the fundamental response to be distorted.

Resonator 10 operates by varying the distance between tuning screw 14 and dielectric 11. As the distance between tuning screw 14 and dielectric 11 decrease the electric field of resonator 10 is affected, which also affects the magnetic field since the two are related by Maxwell's equations. If tuning screw 14 is made of a dielectric substance then the electric field is affected in a manner that will decrease the fundamental and spurious responses. As the spurious responses decrease faster than the fundamental this causes the spurious response to approach the fundamental response. If bolt 14 is made of a metal then the electric field is affected in a manner that will increase the fundamental response and decrease the spurious response again causing the spurious response to approach the fundamental response.

By changing the structure of the transmission medium used and its position relative to the resonator, the electrical coupling of the various modes can be altered.

The height/diameter ratio of the resonator and the resonator's relation to its surroundings will determine the frequency of each of the modes ($TE_{01\delta}$, $TM_{01\delta}$, $HE_{11\delta}$, $EH_{11\delta}$). The present invention has been designed to couple the $TE_{01\delta}$ (fundamental) mode at a lower frequency than the spurious modes ($TM_{01\delta}$, $HE_{11\delta}$, and $EH_{11\delta}$).

Figure 2:
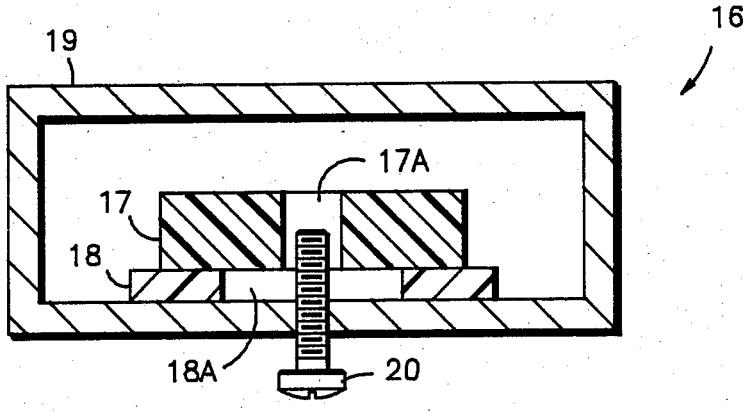
FIG. 2 is a cross sectional diagram of a ring shaped dielectric resonator embodying the present invention.

Referring now to FIG. 2 a resonator, generally designated 16, embodying the present invention is illustrated. Resonator 16 consists of a ring shaped dielectric 17 having an opening 17A mounted on a pedestal 18 having an opening 18A. Pedestal 18 is attached to ground plane 19 which encloses resonator 17. Threadedly engaged in ground plane 19 and inserted into opening 17A and 18A is a tuning screw 20 which is of either a dielectric or metal substance, depending on the type of tuning required. Resonator 16 requires dielectric 17 be ground to a tolerance of ±2.0% of its desired dimension, which is a wider tolerance than the ±0.5% required by resonator 10, FIG. 1. This tolerance level is easily accomplished by present manufacturing capabilities. Resonator 16 has a tuning range of 2.0% of the resonant frequency, or a 2000% increase over the prior art resonators, FIG. 1, tuning range of 0.1%.

Resonator 16 operates under a theory of tuning screw 20 perturbing the electric field of resonator 16. When energy is transmitted to resonator 16, an electric field is created about dielectric 17. As tuning screw 20 enters opening 17A the electric field is perturbed causing a change in the frequency of the fundamental mode ($TE_{01\delta}$) and the spurious responses ($TM_{01\delta}$, $EH_{11\delta}$, and $EH_{11\delta}$). If tuning screw 20 is made of a dielectric substance then the electric field is affected in a manner that will decrease the fundamental and spurious responses. If tuning screw 20 is made of a metal then the electric field is affected in a manner that will increase the fundamental response and decrease the spurious response. The effects on the fundamental and spurious responses, while similar to the prior art in the direction of movement, differ substantially from the effects caused by the prior method of tuning.

Figure 3:
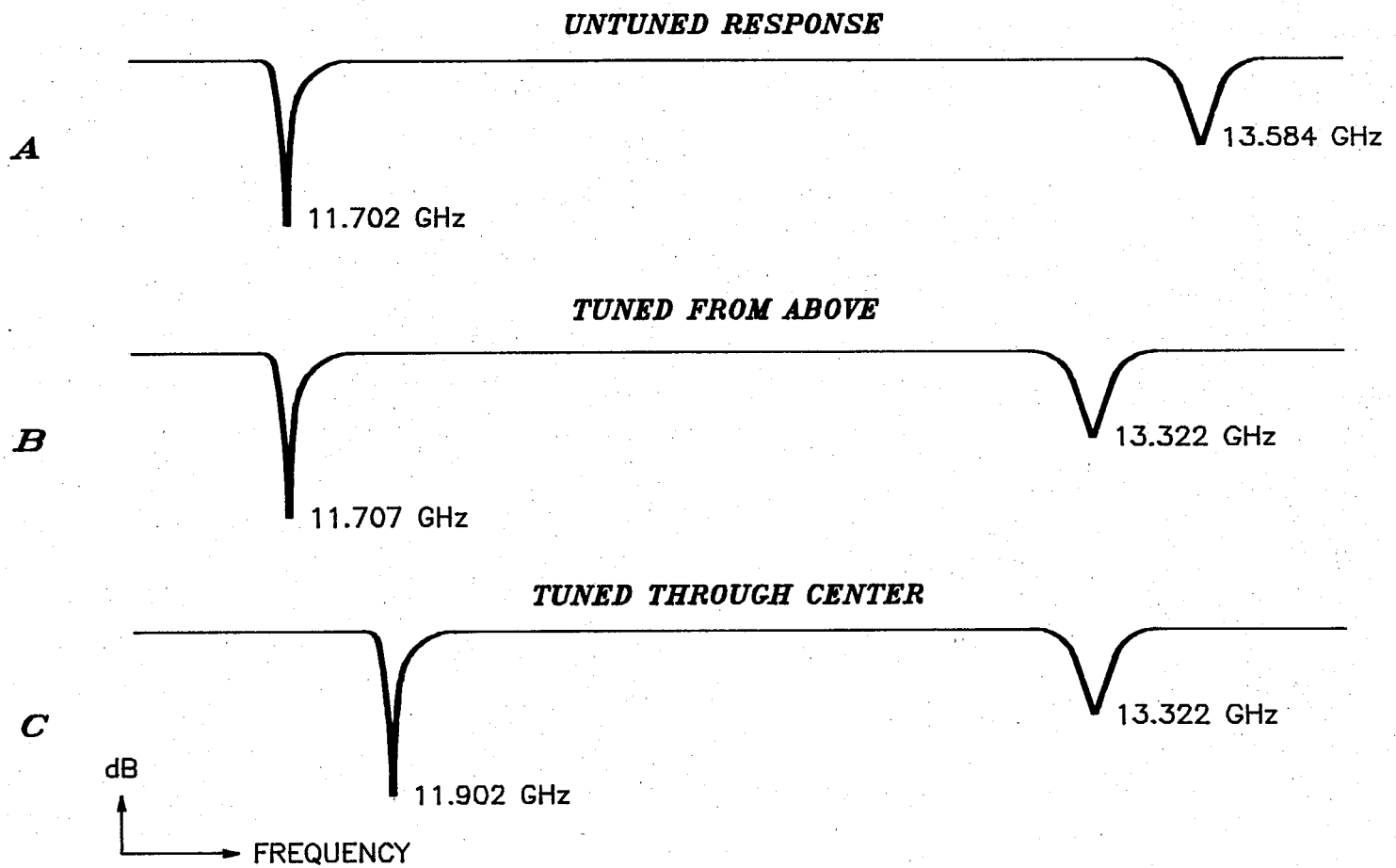
FIG. 3 is a graph of dielectric resonator frequency responses for an untuned dielectric resonator, a dielectric resonator tuned from above and a dielectric resonator tuned by the present invention.

Referring now to FIG. 3, graphs of dielectric resonator frequency responses are illustrated. Graph A illustrates the response of an untuned resonator, where the fundamental response is found at 11.702 GHz and a first spurious response, an unwanted response, is found at 13.584 GHz. Graph B illustrates the response of a resonator tuned from above. Here the fundamental response has been tuned from 11.702 GHz to 11.707 GHz, an increase of 5 MHz. Tuning the fundamental response up 5 MHz has caused the first spurious response to be tuned down 262 MHz to 13.322 GHz for a ratio of 1:52, or for each MHz the fundamental response increases the spurious response decrease 52 MHz. When the spurious response remains removed from the fundamental response the spurious response may be filtered out. As the spurious response approaches the fundamental response it may not be filtered without also filtering the fundamental response and, as a result, reduces the tuning ability of the resonator. In this example the fundamental response and spurious response will continue to approach each other until they meet at 11.738 GHz.

In Graph C a frequency response graph for a resonator embodying the present invention, tuned from below, is illustrated. Here the fundamental response is tuned up 200 MHz to 11.902 GHz, before the first spurious response is tuned down the 262 MHz as in FIG. 3B. This is a ratio of 1:1.31, for each MHz the fundamental response moves the spurious response moves 1.31 MHz which allows a much wider tuning range over the method of FIG. 1. In this example the fundamental response and spurious response will continue to approach each other until they meet at 12.517 GHz giving an additional 779 MHz of tuning.

In graphs B and C the fundamental responses were increased by using a metallic bolt. These fundamental responses may be tuned down by using a dielectric bolt, however, the spurious response will still be tuned down and approach the fundamental response.

While the method of tuning the dielectric resonator from below results in a more accurate tuning method there is no loss in Q, quality factor, in the resonator from that of tuning from above.

The present invention, therefore, by utilizing the method of tuning the dielectric resonator from below enables a much wider range of tuning to be accomplished. Further, this wider range of tuning is accomplished without a loss in the quality factor, Q, of the resonator.

By now it should be appreciated that there has been provided a novel apparatus and method to increase the tuning bandwidth without having spurious responses interfering with the fundamental response. The present invention requires less dimensional tolerances providing a more practical and economical product. Further, the present invention operates without a loss in the quality factor as compared with prior methods.

While a preferred embodiment of the present invention has been disclosed and described, it will be obvious to those skilled in the art that various modifications and substitutions may be made without departing from the spirit and scope of the invention, and it is therefore aimed in the following claims to claim all such modifications.

We claim:

1. A method of tuning a dielectric resonator having a fundamental response signal, and a spurious response signal, said method comprising the steps of:

providing a dielectric resonator symmetrically disposed about a central axis thereof, said dielectric resonator defining an opening therethrough symmetrically disposed about said axis and coaxial therewith;

providing a mounting means for supporting said resonator, said mounting means having a first surface perpendicular to said axis, a second surface parallel to and opposite from said first surface, and said mounting means being radially disposed about said axis, said mounting means defining an opening therethrough coaxial with said axis, and said first surface of said mounting means being coupled to said resonator;

providing a ground plane having a first surface perpendicular to said axis, said ground plane defining an opening therethrough coaxial with said axis, and said first surface of said ground plane being coupled to said second surface of said mounting means;

providing a tuning means for tuning the frequency of said fundamental signal and having a de minimis effect on the frequency of said spurious signal of said dielectric resonator, said tuning means being disposed coaxial with said axis and being adjustably coupled to said ground plane, said tuning means extending through the opening of said ground plane and being adjustably extendable through the openings of said mounting means and said resonator;

inserting said tuning means through said ground plane and into the openings of said mounting means and said resonator, said tuning means perturbing an electric field of said resonator; and adjusting said tuning means thereby setting the frequency of said fundamental signal of said dielectric resonator to provide a desired resonance.

* * * * *